US005290175A

United States Patent [19]

Robinson et al.

[11] Patent Number: 5,290,175

[45] Date of Patent: * Mar. 1, 1994

[54] MODULAR HIGHER DENSITY COMMUNICATIONS COUPLING SYSTEM

[75] Inventors: Scott T. Robinson, Redmond; William K. Denning, Everett; John M. Redfield, Brier; John H. Garthwaite, Coupeville, all of Wash.

[73] Assignee: Leviton Manufacturing Co., Inc., Little Neck, N.Y.

[ * ] Notice: The portion of the term of this patent subsequent to Apr. 21, 2009 has been disclaimed.

[21] Appl. No.: 815,648

[22] Filed: Dec. 30, 1991

Related U.S. Application Data

[63] Continuation of Ser. No. 719,053, Jun. 21, 1991, Pat. No. 5,106,325, which is a continuation of Ser. No. 647,378, Jan. 28, 1991, abandoned, which is a continuation of Ser. No. 463,328, Jan. 19, 1990, Pat. No. 5,007,860.

[51] Int. Cl.[5] ..... H01R 13/60

[52] U.S. Cl. ..... 439/540; 439/535

[58] Field of Search ..... 174/66; 439/535, 536, 439/538, 540, 544, 562, 571, 676, 108

[56] References Cited

U.S. PATENT DOCUMENTS

| | | | |
|---|---|---|---|
| 4,655,529 | 4/1987 | Yokoyama | 439/535 |
| 4,875,880 | 10/1989 | Welch et al. | 439/557 X |
| 5,106,325 | 4/1992 | Robinson et al. | 439/540 |

*Primary Examiner*—Eugene F. Desmond
*Attorney, Agent, or Firm*—Paul J. Sutton

[57] ABSTRACT

A modular higher density communications coupling system including a universal platform for supporting multiple connectors from a single outlet hole is disclosed. The platform includes a main body member having a registration ridge extending forward of the main body member for extending into a standard sized outlet hole. A pair of apertures adjacent to each other extend through the main body member and are generally surrounded by the registration ridge. A pair of connector housings are attachable to the rear of the platform in alignment with the apertures for housing connectors. A pair of retaining members on two sides of the apertures hold the connector housings in position. A pair of support members extend rearwardly from the main body of the platform on the other two sides of the apertures. A termination plate is mounted in the support members, the termination plate having a plurality of electrical couplings for connecting the wire from a wall to the connector. A grounding screw mount provides easy access from the front, side or rear. The relationship between the retaining members, apertures, and support members facilitates a higher density of electrical couplings than previously possible in the prior art. Telecommunications apparatus of the type identified within the specification, in combination with the aforesaid, is contemplated as coming within the scope of the present invention.

4 Claims, 5 Drawing Sheets

FIG. 6
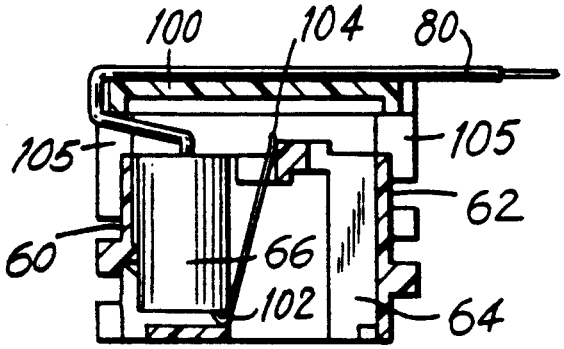
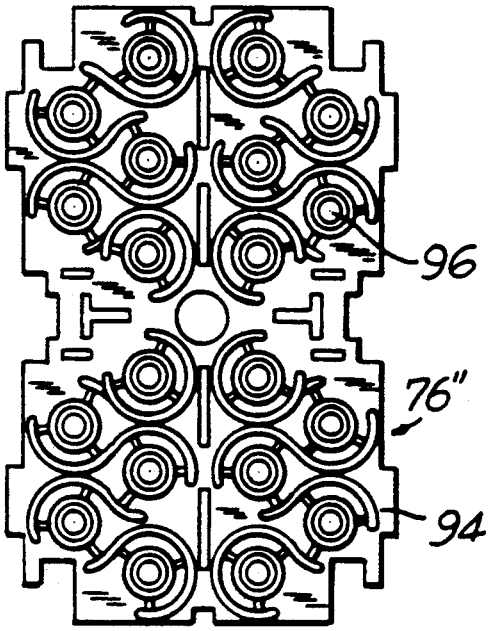
FIG. 8

MODULAR HIGHER DENSITY COMMUNICATIONS COUPLING SYSTEM

This is a continuation of U.S. patent application Ser. No. 07/719,053 filed Jun. 21, 1991, now U.S. Pat. No. 5,106,325. U.S. patent application Ser. No. 719,053 is a continuation of U.S. patent application Ser. No. 07/647,378 filed Jan. 28, 1991 and now abandoned. U.S. patent application Ser. No. 07/647,378 is a continuation of U.S. patent application Ser. No. 07/463,328 filed Jan. 19, 1990 and now U.S. Pat. No. 5,007,860.

TECHNICAL FIELD

This invention relates to telecommunication equipment wall connectors, and more particularly, to a platform for supporting multiple telecommunication connectors from a single industry standard wall outlet.

BACKGROUND OF THE INVENTION

The need for increased telecommunication interconnections in the office and home has skyrocketed in recent years because of the increased use of computers and other telecommunication equipment for communications. Not many years ago, a standard office usually required only a single communication wall connector (i.e., a telephone jack) between a worker and the outside world. Telephone jacks were provided throughout the building on the basis of one connector per worker requiring a telephone.

The increased use of numerous audio-visual, computer, facsimile machines, and cable equipment for communication has significantly increased the requirement for telecommunication connections. A single worker may require coupling to a computer network, a modem coupling, a telephone coupling, coaxial cable for cable communications, cable television, fiber-optic cable, or other connections. Another worker may require only a single connection, such as a telephone, to the outside world. Providing the required wall connectors for each worker is an expensive and monumental task for designers of today's office space and communication layouts.

A problem with current wall connector configurations is the existence of numerous types of connectors and different standards of interconnections between electrical couplings. A user may require a standard registered jack (RJ) of the type used for telephone equipment. In other locations, the user may require a balun, a coaxial connector, a fiber-optic cable connector, or yet another style connector. Further complicating these requirements are the different industry standards for terminating such connectors. In the U.S., one standard termination scheme is a 110-type insulation displacement connector (IDC). An older-type termination scheme still used in the U.S. is a screw termination in which the wires are stripped and clamped together with screws. In Europe, an industry standard is a Krone~-type IDC termination. The requirement to couple to the different types of termination schemes while providing the desired wall connector presents difficult problems for those companies providing telecommunication wall connectors.

SUMMARY OF THE INVENTION

It is therefore an object of this invention to provide a single platform providing a higher density of telecommunication connectors than previously possible in an industry standard configuration.

It is a further object of this invention to provide a platform to mount a plurality of different style connectors as selected by a user.

It is another object of this invention to provide a platform which accommodates numerous different termination schemes between the connectors and the telecommunication network from a single platform as, selected by a user.

These and other objects of the invention, as will be apparent herein, are accomplished by providing a platform for mounting a pair of connectors through an industry standard-sized hole of a wall outlet cover plate. The platform includes a main body member having a registration ridge extending forward of said main body member for extending into the industry standard-sized outlet hole. A pair of apertures adjacent each other extend through the main body member and are generally surrounded by the registration ridge. A pair of retaining members extend rearwardly from the rear face of the main body member, adjacent to said apertures. A pair of connector housings are coupled to the rear face of the platform by the retaining members. A connector is mounted in each connector housing in alignment with the apertures for providing connection to the selected connector through the aperture. The retaining members are resiliently deformable to permit the connector housings to be easily snapped into or removed from the platform, both in the factory and in the field.

A pair of support members extend rearwardly from the main body of the platform, adjacent to said apertures. A termination plate is mounted in the support members. The termination plate includes a plurality of terminations for connecting the connector to the wire in the wall. The relationship between the retaining members and support members facilitates a high density of terminations.

The platform is usable in existing or new installations to provide more telecommunication connectors than possible with the same industry standard configurations in the prior art. Additionally, the ability of a single platform to accommodate many different types of connectors and respective terminations to the connectors saves considerable money and resources in designing and building individual electrical connectors for each connector and termination. Savings in tooling costs, inventory control and inventory supplies are also achieved by using a modular system and a universal platform.

BRIEF DESCRIPTION OF THE DRAWINGS

FIG. 6 is a cross-sectional view of a protective cap mounted on the retaining members of the platform.

FIG. 8 is a back elevational view of a screw-type termination plate.

DETAILED DESCRIPTION OF THE INVENTION

Figure 1:
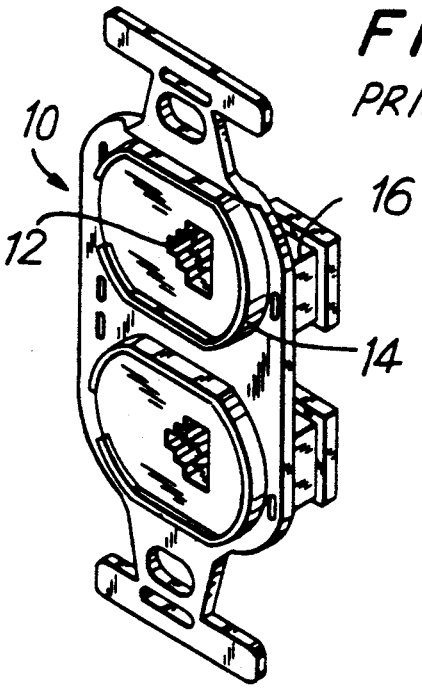
FIG. 1 PRIOR ART
FIG. 1 is an isometric view of a prior art, electrical connector.

FIG. 1 illustrates a prior art electrical connector 10 for placing in an industry standard outlet box. A single aperture 12 is generally surrounded by a ridge 14. The ridge 14 is approximately the same shape as the industry standard hole of an outlet cover plate (not shown). The particular electrical connector illustrated in FIG. 1 is a housing that retains a jack 16 of the type normally used for telephone connections. The connector 16 is a unitary member of the mounting electrical connector 10, both being molded in the same injection mold.

For each electrical connector 10 having a different type of connector, the electrical connector must be designed, molded, and tested. It must then be certified to pass industry standard requirements prior to selling on the market. Designing a new electrical connector with a different type of connector may cost thousands of dollars and take several months, thereby significantly delaying the offering of a new product by a company to a consumer. A further disadvantage of the prior art electrical connector of FIG. 1 is the limitation of one connector per industry standard outlet hole. The increased use of telecommunication equipment often requires numerous connectors for a single worker. A plurality of different industry outlet boxes must therefore be provided for each worker if the prior art electrical connectors are used, increasing the inventory and inventory control problems, not only for the manufacturer but for the individual worker as well. Some prior art products form a custom hole or a pair of holes in a custom cover plate to increase the density of telecommunication connections. Unfortunately, providing custom parts is more expensive because custom tooling and design is required. Custom parts often do not mate with other industry standard components. Use of the prior art product thus increases the costs involved to provide multiple connections. Further, prior art products are not available in many of the configurations desired by the consumer.

Figure 2:
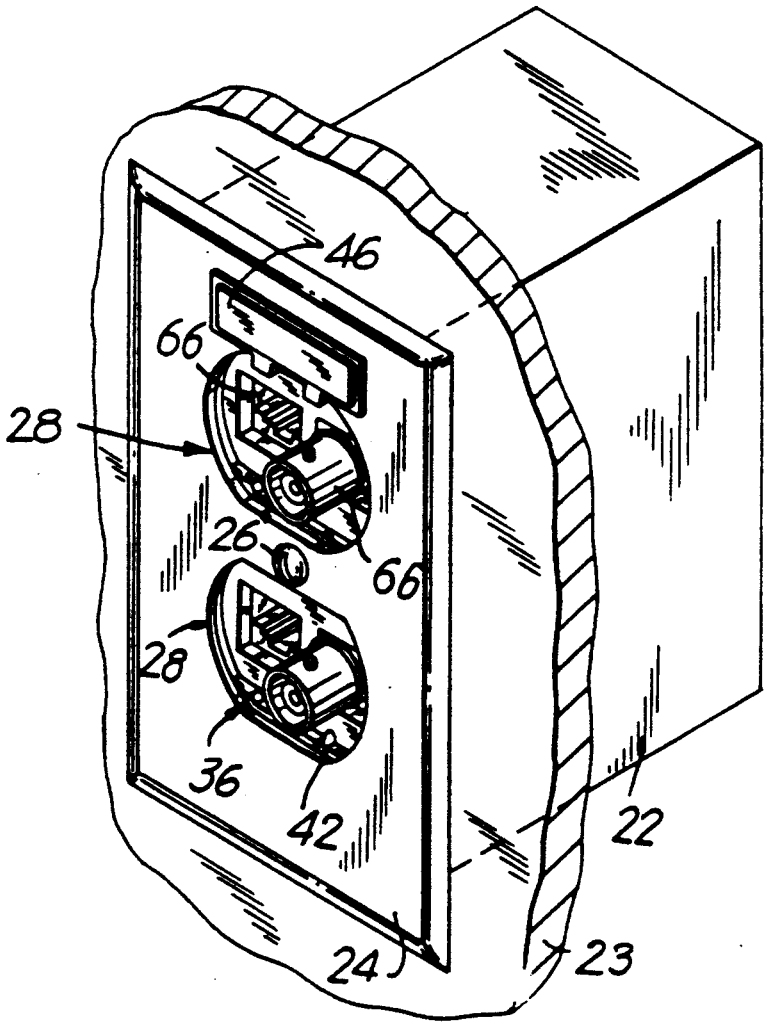
FIG. 2 is an isometric view of the inventive platform within an industry standard wall outlet box having connectors extending through a cover plate mounted thereto.

The platform 20 of the present invention is shown in FIG. 2 within an industry standard outlet box 22 mounted in a wall 23. The outlet box 22 is of standard size in height, width, and depth as defined by NEMA standards which is the industry standard for this field. The platform 20 has a height, width, and depth to fit within the industry standard outlet box 22. A cover plate 24 fits flush against the wall 23 and is threadably coupled by a screw 26 to the platform 20. The cover plate 24 has two holes 28. The shape and size of hole 28 are defined by the NEMA industry standard. Two connectors 66 are aligned with each hole of the cover plate 24. An identification plate 46 is attachable, at the option of the user, to the cover plate 24 to identify the outlet and wiring connections associated with the connectors 66.

Figure 3:
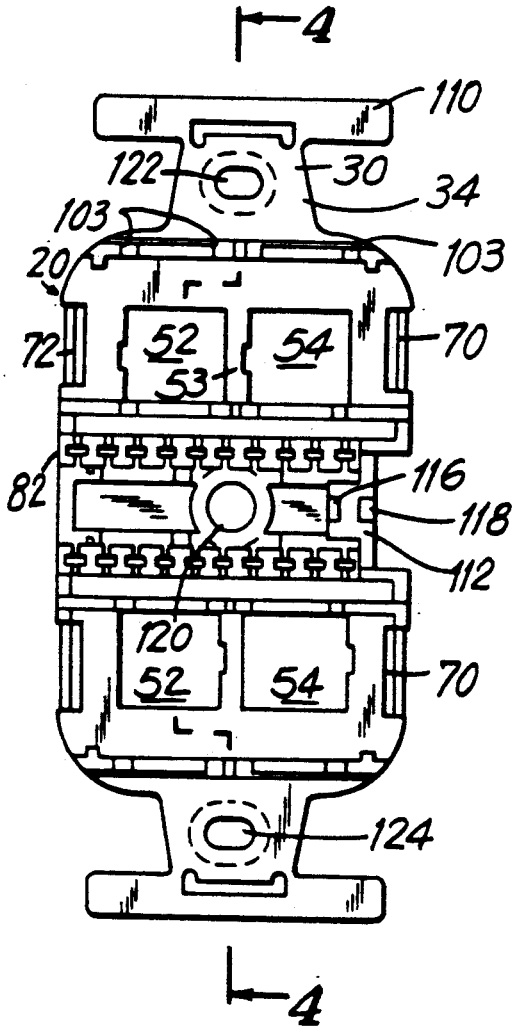
FIG. 3 is a rear elevational view of the platform.
Figure 4:
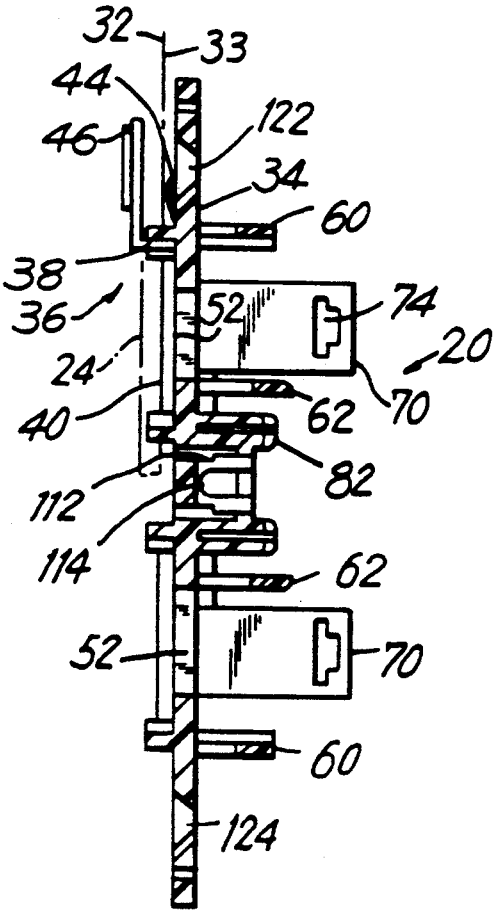
FIG. 4 is a cross-sectional view taken along lines 4—4 of FIG. 3.

As illustrated in FIGS. 3 and 4, the platform 20 includes a main body member 30 having a front face 32 and a rear face 34. A pair of apertures 52 and 54 extend through the main body member 30 in alignment with each of the cover plate holes 28. A separation bar 53 defines a common side for the apertures 52 and 54. The apertures 52 and 54 are sized to permit many styles of connectors to extend therethrough. If desired, the separation bar 53 may be removed to provide a single large aperture.

Figure 7:
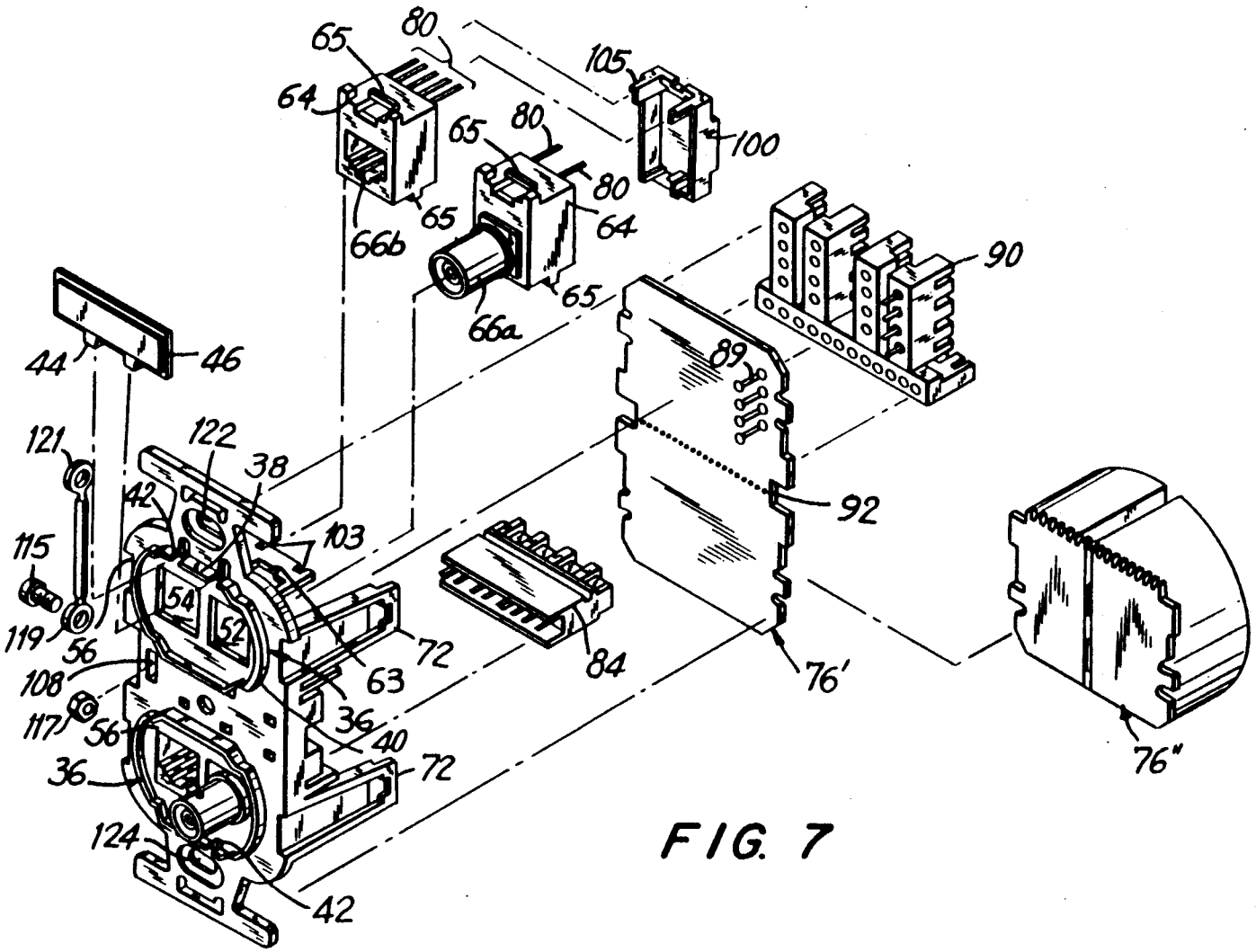
FIG. 7 is a front isometric, exploded view of the platform illustrating a plurality of different connectors and electrical couplings attachable thereto.

As shown in FIGS. 4 and 7, a registration ridge 36 extends forward from the front face 32 of the main body member 30, and generally surrounds the apertures 52 and 54. As best illustrated in FIG. 4, the registration ridge 36 includes a first pair of higher, raised portions 38 and a second pair of shorter, raised portions 40. As illustrated in FIG. 2, the first raised portions 38 extend into the cover plate hole 28 and are spaced apart by a distance just smaller than the corresponding dimension of the hole so as to position the main body member 30 in proper registration with the hole 28. The second, shorter, raised portions 40 do not extend through the hole (being spaced apart by a distance larger in diameter than the hole). The second raised portions 40 of the registration ridge 36 are spaced laterally outward with respect to the hole 28 to leave a portion 56 of the body member 30 between the apertures 52 and 54 and the closest portion of the second raised portions 40. Spacing the second portion 40 slightly further outward from the corresponding aperture permits the pair of apertures 52 and 54 of the selected size to fit inside of the registration ridge 36 which mates with an industry standard hole 28. The second portions 40 abut against a rear surface 33 of the cover plate 24 in a tight-fitting relationship to rigidly hold the cover plate 24 to the main body member 30 in a position spaced slightly in front of the front face 32 of the main body member. The registration ridge 36 having the first raised portions 38 through the hole 28 and the shorter, second raised portions 40 abutting against the cover plate material surrounding the hole, provides for alignment and a secure fit of the body member 30 with respect to the hole 28. Tightening the screw 26 pulls the first raised portions 38 into the hole 28 to ensure a positive positioning of the apertures 52 and 54 with respect to the corresponding hole 28, while clamping the shorter portions 40 against the rear surfaces 33 of the cover plate 24.

A pair of recessed slots 42 are provided in the first raised portions 38 of the registration ridge 36, as best illustrated in FIG. 7. Attachment tabs 44 on the identification plate 46 extend through the slots 42 and behind the cover plate 24, to hold the identification plate 46 in position, as shown in FIG. 4.

Figure 5:
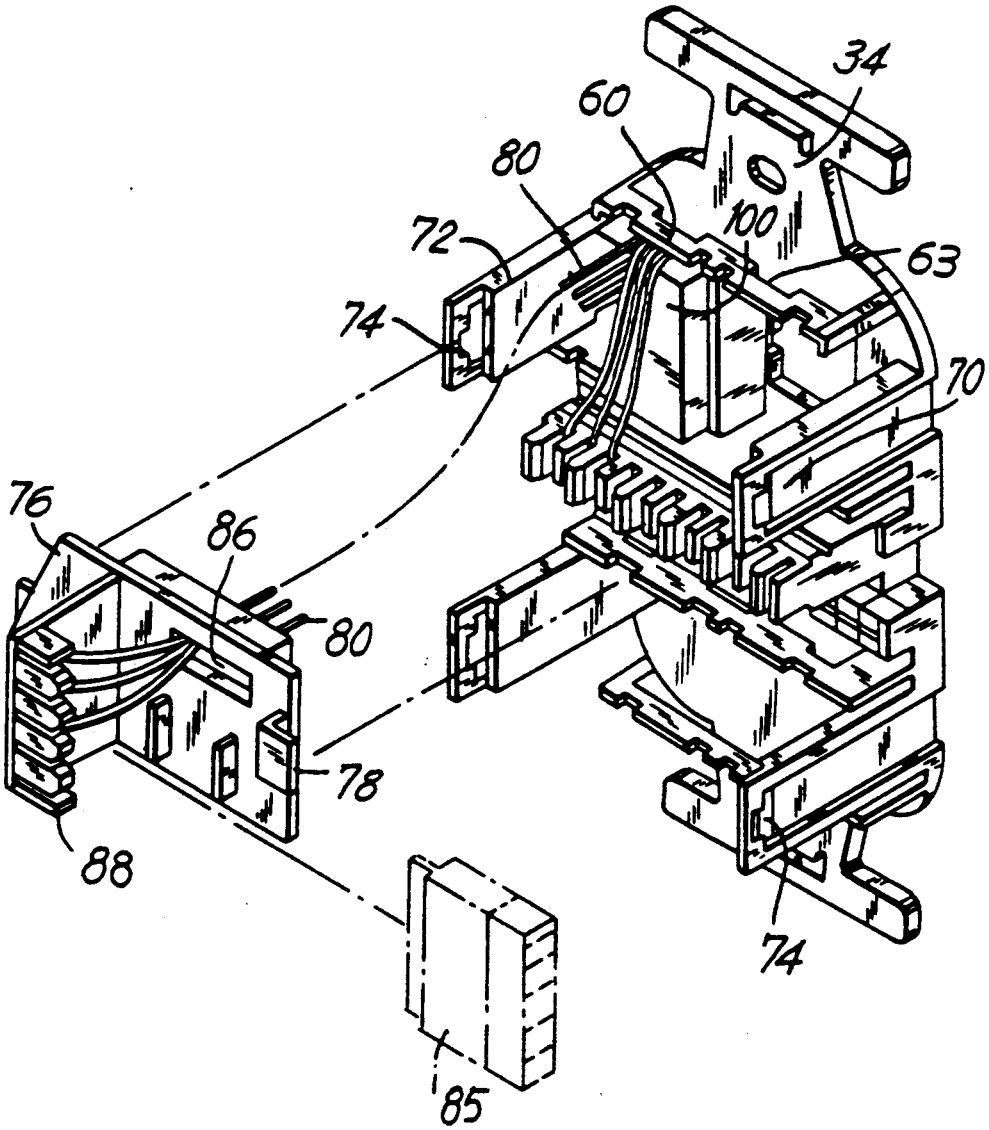
FIG. 5 is a rear isometric, exploded view of the inventive platform illustrating a termination plate attachable to the support members.

As best illustrated in FIG. 5, and shown in cross section in FIG. 4, a pair of resilient retaining members 60 and 62 extend from the rear face 34 of main body member 30 for each pair of apertures 52 and 54. The retaining members 60 and 62 are positioned on the two opposing sides of the pair of apertures 52 and 54, one above and the other below the apertures. A pair of connector housings 64 are positioned between and removably held in place by the retaining members 60 and 62. The retaining members 60 and 62 include a plurality of recesses 63 for mating with corresponding tabs 65 on the connector housings 64, as best shown in FIG. 7. The retaining members 60 and 62 are formed integral with the main body member 30, being injection-molded as a single-piece unit. The plastic used for the main body member 30, and hence the retaining members 60 and 62, provides the members, which are molded as a thin strip, with resiliency and flexibility. To insert a connector housing 64 between the retaining members 60 and 62, the members are spread apart slightly outward and the connector housing 64 is moved into position therebetween. The retaining members, being resilient, snap back into position around the connector housing 64, with the housing tabs 65 fitting into the member recesses 63, to firmly retain the housing abutting against the rear face 34 of the main body member 30, with the connector housing aligned with a respective one of the apertures 52 and 54. The connector housing 64 may be easily removed by deforming the retaining members outward and pulling the housing between them. A resilient hook or other type of catch could be used for retaining members 60 and 62 if desired to accomplish the intended purpose of retaining the connector housings 64 in position, while permitting easy insertion and removal both in the field and during manufacture.

The connector housing 64 has a surface width and height, known as the "footprint," significantly larger than the corresponding one of the pair of apertures 52 and 54 at which the connector housing is positioned and through which the connector to be inserted into the connector housing projects. If two of the connector housings 64 are placed side by side, the combined footprint is significantly larger than the industry standard-sized hole 28 in cover plate 24. According to one aspect of the invention, the connector housing 64 is positioned with its forward end at the rear face 34 of the main body member 30, rearward of the corresponding aperture through which the connector projects, and significantly rearward at the cover plate hole 28. By so placing the connector housing 64, two connectors can be mounted side-by-side for extending through a single industry standard-sized hole 28, which was not possible in the prior art.

Any one of a plurality of different style connectors may be mounted in the connector housing 64, as selected by a user. In FIG. 7, an RJ connector 66*a* is shown in one connector housing and a balun connector 66*a* is shown in the other housing. Other style connectors which may be used with the connector housing 64 include a 2-wire, 4-wire, 6-wire-, or 8-wire, keyed, MMJ, or shorting bar RJ connector. A coaxial connector (BNC, TNC, or F), a fiber-optic cable connector (ST, SMA, FDDI), or a pass-through connector having a connector extending from both the front and rear of the connector housing 64 may also be mounted in the connector housing 64.

The particular connector housing 64 illustrated in FIG. 7 is a 652 envelope, known in the prior art. The prior art 652 envelope has a predetermined configuration of a selected height, width, depth, and surface shape. The retaining members 60 and 62 are shown adapted for holding a connector housing with a 652 envelope, but could be shaped to accommodate different configurations of connector housings 64, such as a 641 envelope, if desired. The advantage of using a connector housing 64 with the prior art 652 envelope is that numerous style of connectors are presently available, mounted within the 652 envelope.

As shown in FIGS. 3 and 4, two industry-standard Insulation Displacement Connectors "IDC" termination strips 82 extend rearwardly from rear face 34 of main body member 30. Each of the particular IDC termination strips 82 shown mates with a 110-type termination 84, shown in FIG. 7. In a 110-type termination 84, wires from the four connectors 66 used with the platform are selectively placed in the termination strip 82. The mating termination 84 is then press-fit into the strip 82. The termination 84 provides electrical connection to the connector wires from the wires (not shown) in the wall 23 provided to the outlet box 22 in a known manner. The rear face of the prior art platform of FIG. 1 has two similar termination strips extending therefrom for receiving a similar termination for the two connectors used, this type of termination being well known in the prior art. Each termination strip 82 provides ten slots for terminating ten wires, for total of twenty wires when using two termination strips. As will be described below, when using four connectors 66, each with eight wires, there is a need to provide terminations for thirty-two wires, which is twelve more terminations possible with the two 110-type termination strips 82.

As shown in FIG. 3, the two termination strips 82 extend laterally across the rear face 34, adjacent to a screw hole 120 which is provided to receive the cover plate screw 26. One termination strip is above the hole 120, and one is below it. Some open space around the strips 82 must be present to provide room for placing the wires 80 into the strips 82 and for attaching of the terminations 84. According to one aspect of the invention, this open space is provided at the rear face 34 of the main body member 30 over the screw hole 120. The open spaces for each termination strip 82 are adjacent to, and may overlap each other, providing an even more compact arrangement. The required minimum spacing is thus provided in an area that must be left open anyway because of the screw hole 120. With this arrangement, the placement density of the termination strips 82 can be increased.

Providing two connectors 66 for a single cover plate hole 28 presents significant problems not faced in the prior art. Since a total of four connectors 66 may be mounted in the single platform 20. Each connector 66 may have up to eight wires extending from it for coupling to the wires in the wall, which are part of the office's telecommunications network. As such, the platform 20 must be able to accommodate the coupling of up to thirty-two individual wires 80. In the prior art, a maximum of sixteen wires extended from the connectors used with a single electrical connector and, therefore, termination of only sixteen wires needed to be provided. The prior art electrical connector also had more room to provide these terminations because the space of only two connectors was taken up at the rear face of the electrical connector. Because the platform 20 of the present invention provides the possibility of twice as many wires as the prior art electrical connector, with much less space left available due to the presence of four connectors 66, significant problems must be solved to accommodate the coupling of thirty-two wires from the connectors to the wires in the wall, which are part of the office telecommunication network. The configuration, shape and/or dimensions of the connectors 66, cover plate 24, hole 28, and outlet box 22 are set by industry standards and the platform 20 must conform to these dimension standards so as to mate with industry standard components.

As best shown in FIG. 5, two pairs of support members 70 and 72 extend from the rear face 34 of main body member 30. The support member 70 of each pair is positioned on one side of the pair of apertures 52 and 54, and the support member 72 is positioned on the other side of the pair of apertures. The support members 70 and 72 of each pair face each other and support a termination plate 76. The support members each include a slot 74 at one end for mating with corresponding tabs 78 on one of the termination plates 76. The support members 70 and 72 are formed integral with the platform 20, being injection-molded as a single-piece unit. As with the retaining members 60 and 62, the support members 70 and 72 provide them with resiliency and flexibility so they may be spread apart from each other for placement of one of the termination plates 76 therebetween, with the slots 74 aligned with the tabs 78. The support members, when released, then snap back into position to firmly retain the termination plate 76.

The support members 70 and 72 are longer than the retaining members 60 and 62, and thus hold the termination plate 76 above the connector housings 64. The termination plate 76 spans across a pair of cover plate apertures 52 and 54, and across the connector housings 64 aligned with the respective apertures.

The termination plate 76 includes an additional termination strip 88. The wires 80, which do not fit onto strips 82, extend through an aperture 86 in the termination plate 76 and fit into the slots provided in the strip 88. A termination 85 is attached to the strips 88 to provide the wire terminations. Extending some of the wires 80 through the aperture 86 in the termination plate 76 provides additional protection from the environment to ensure that these wires are not disconnected when mounting the assembled platform 20 into the outlet box 22. The termination plate 76 is attachable to just one pair of support members 70 and 72, but if more terminations are needed, another termination plate can be attached to the second pair of support members.

As shown in FIG. 5, the termination 85 is oriented in a plane transverse to the termination 84, with the termination 85 extending laterally rather than rearwardly. Further, the termination plate 76 is positioned so that it will not be over the termination strips 82, and hence terminations 84, so that an installer may have access to both the terminations 84 attached to the strips 82, and terminations 85 attached to the strips 88, as desired without interference between them. The installer can thus access terminations at two different height levels, and at two different orientations, neither one blocking the other. By arranging the termination 85 and the termination strip 88 to extend perpendicular to the termination strips 82 on the main body member 30, ease of access and greater density are achieved. Since the outlet box has a specified limited depth, care must be taken to ensure that the depth of the platform 20 in combination with the items coupled thereto, does not exceed this depth. Coupling the termination strips 82 to the main body member 30 while extending the additional termination strips 88 laterally achieves the desired density within the interior dimensions of the outlet box 22.

Some customers prefer the use of a Krone~-type IDC rather than a 110-type IDC termination. To accomplish this, a termination plate 76' having a Krone--type IDC 90 termination mounted thereto, is attached by the support members 70 and 72, as shown in FIG. 7. The termination plate 76' is actually a circuit board, having electrical connections 89 extending across the board. The Krone~-type IDC termination 90 is an industry standard more popular in Europe than in the United States. Wires 80 extend from the connectors 66 and are coupled to the Krone~-type IDC termination 90 for electrical coupling to the wires from the wall in a manner well known in the art.

Up to twenty-four Krone~- type IDC terminations (or thirty-two in some embodiment) may be mounted on a single termination plate 76' and thus twenty-four wire terminations made. Mounting the termination plate 76 in the support members 70 and 72, both the plates spanning across the apertures 52 and 54 and above the connector housings 64, provides significantly increased density of electrical wiring over that possible in the prior art using the Krone~-type IDC.

If the type of connector 66 extending through the aperture 52 or 54 is a pass-through connector, having a connector extending from each end of the connector housing 64 with no wires to be terminated, the termination plate 76' may be broken in half at perforations 92 and one-half the plate removed. Then only one-half the termination plate 76' would be supported by one pair of the support members 70 and 72. The wires 80 extending from connectors 66 in platform 20 would extend to, and be terminated at the Krone~-type termination 90 or the remaining one-half of the termination plate 76', while permitting pass-through connectors to extend undisturbed by the other, removed one-half of the termination plate.

FIG. 8 better illustrates a third type of termination plate 76", which is a screw coupling for retaining wires. It is an industry standard termination scheme well known in the prior art and used throughout the United States and Europe. If the user desires wires to be coupled using a screw-type electrical coupling, the appropriate screw couplings 96 are attached to the termination plate 76" and the termination plate is mounted between the support members 72 and 70, as has been described with respect to plate 76. Any other selected style of termination may be attached to the termination plate, as desired. For example, different types of IDC connectors (such as a 66-type IDC), circuit boards, or other wire termination schemes may be mounted on a termination plate for use with connectors 66 mounted in the platform 20 of this invention and held in place by the support members 70 and 72.

Generally, two different types of terminations are not used on the same platform, but for purposes of illustration, FIG. 7 shows alternative termination plate configurations. Shown in FIG. 7 is the 110-type termination 84 which would be used with the termination plate 76 shown in FIG. 5. Also shown is the Krone~-type termination plate 76' just described above. The ability to selectively mount a Krone~IDC termination 90 or 110-type IDC termination 84 on the universal platform 20 provides significant cost and production advantages. Yet a third alternative type of termination plate 76" the screw type termination is shown in FIG. 7 and can be used instead of a 110- or Krone~-type termination.

As shown in FIGS. 6 and 7, a protective cap 100 may be mounted directly over the rear of the connector housing 64. The cap 100 is supported by the retaining members 60 and 62, and mates with slots 103 provided in these members. Some connectors, such as an RJ-type connector, include bare contacts 102 (see FIG. 6) to which a telephone jack couples. The bare contacts 102 may have a portion 104 extending out of the connector housing 64. The protective cap 100 extends over the rear of the connector housing 64 and holds the wires 80 above the housing to ensure that the wires do not lie on or make electrical contact with the extending portion 104. Although the wires 80 are insulated, use of the protective cap 100 provides additional safety to prevent undesired shorting and increases the reliability of the connection. It also provides additional protection to ensure that the insulation of the wires 80 is not cut on the extending portion 104. Other types of electrical connectors may include larger portions of exposed conductors, such as a shorting bar, and the protective cap 100 provides additional protection for such types of connectors as well. Having retaining members 60 and 62 extend laterally across the main body member 30 and placing mating slots 103 in the retaining members, provides a solid and reliable support for the protective cap 100.

As shown in FIGS. 3 and 7, a mounting detail 112 for a common grounding screw arrangement 115 extends rearwardly from the rear face 34 of the main body member 30. The mounting detail 112 includes a side aperture 114 for receiving an electrically conductive screw 115. The front face 32 of the main body member 30 includes an aperture 108 for receiving a metal nut 117 for holding the screw 115. The screw 115 extends through a ground ring 119 and through the nut 117 to securely hold the ground ring 119. If grounding of any wires is required, they are coupled to a conductor 121 electrically connected to the ground ring 119. A technician is also provided access to ground and can conveniently place a probe on the screw 115 or on the ring 119 or not 117 as a ground reference. Having the mounting detail 112 and common grounding nut and screw on one side of the platform 20 advantageously provides easy access to the grounding screw. The access provided also facilitates coupling of wires to the conductor 121.

Generally, the platform 20 is completely assembled by the manufactured with the terminations and termination plates as needed and selected by the customer. The manufacturer places the selected connectors 66 into the housings 64, inserts the housings 64 into the retaining members 60 and 62, and terminates the wires 80 by attaching terminations 84 and termination plates 76, 76', or 76", as needed. The user installs the assembled platform 20 into the industry standard outlet box 22 and attaches the cover plate 24 to begin use of the telecommunication connectors. Occasionally, a user may desire to change the type of connector or termination in the field. Interchangeability of the connectors and termination plates in the field is easily accomplished with the platform 20 of this invention. The user simply removes the connector housings 64 by resiliently deforming the retaining members 60 and 62 and termination plate, if provided. The user then places the newly selected connector in its housing into the retaining members and places the platform back into the outlet box 22. The platform may also be shipped by the manufacturer with one or more apertures empty, providing a blank spot into which the user may insert any selected connector. The platform thus has the versatility to permit full assembly by the manufacturer, reconfiguration in the field after installation, or configuration in whole or in part by a user in the field.

The platform 20 is mountable in either a wall outlet box or a floor outlet box (monument), or mud rings or back boxes. When mounting in a wall outlet box 22, a set of extending ears 110 (see FIG. 3) assist in positioning within the outlet box. Screws extend through holes 120, 122, and 124 in a manner well known in the art for mounting in the outlet box 22 or the plate 24 to the platform. The ears 110 are detachable from the main body member 30 in a manner well known in the prior art for mounting the platform 20 within a monument outlet box using the same holes. The platform 20 is symmetrical about a horizontal plane through the central hole 120 (as oriented in FIG. 3) with the top half and bottom half of the platform being generally mirror images of each other.

A universal platform 20 for providing high-density connections through an industry standard hole 28 has been described. The additional problems created by the high-density packing of connectors are solved by the unique shape of the platform 20 and by providing support members 70 and 72 extending from a rear face for receiving a selected termination plate. Many variations of the basic concepts illustrated herein are possible, and any equivalent structure which falls within the scope of this invention is covered by the claims of this invention.

We claim:

1. A telecommunications coupling device for mounting a pair of connectors through a single hole of an outlet plate comprising:
   - telecommunication apparatus capable of voice or data transmission;
   - a main body member;
   - a registration ridge extending forward from said main body member, at least a portion of said ridge being adapted to extend into said single hole of said outlet plate;
   - an aperture enclosure extending through said maint body member and generally surrounded by said registration ridge;
   - a pair of connectors extending through said aperture means and through said hole in said outlet plate for providing a connection to said telecommunication equipment;
   - a retaining member means for said apertured enclosure, said retaining member extending rearwardly from said main body member on at least one side of said apertured enclosure for retaining a pair of connectors in alignment with said apertured enclosure; and
   - a support member means for supporting a termination plate above said retaining member means and spanning said apertured portion, said support member means extending rearwardly from said main body member, adjacent said apertured enclosure.

2. A telecommunications coupling device for mounting a pair of connectors through a single hole of an outlet cover plate comprising:
   - a main body member;
   - a registration ridge extending forward from said main body member, at least a portion of said ridge being adapted to extend into said single hole of said outlet cover plate;
   - said main body member having an apertured portion extending therethrough and said registration ridge partially extending around the periphery of said apertured portion;
   - said apertured portion having two apertures located side by side therein, with each aperture being capable of closely fitting an end of a connector thereon;
   - a retaining member means extending rearwardly from said main body member on at least one side of each of said two apertures for retaining a pair of connectors in alignment with said apertured portion; and
   - a support member means for supporting a termination plate above said retaining members and spanning said apertured portion, said support member means extending rearwardly from said main body member, adjacent said apertured portion.

3. A telecommunications coupling device for mounting a pair of connectors through a single hole of an outlet plate comprising:
   - a main body member;
   - a pair of apertured portions respectively located in the top and bottom halves of said main body member, each of said apertured portions having two apertures located side by side thereon, with each aperture being capable of closely fitting an end of a connector therein;

respective retaining member means for each one of said pair of apertured portions, each said respective retaining member extending rearwardly from said main body member on at least one side of each of said two apertures for retaining a pair of connectors in alignment with a respective one of said pair of apertured portions; and respective support member means for supporting a termination plate above each of said respective retaining member means and respectively spanning one of said pair of apertured portions, said respective support member means extending rearwardly from said main body member, respectively adjacent one of said pair of apertured portions.

4. The telecommunications device of claim 3, further comprising at least one respective registration ridge partially extending around the periphery of each of said pair of apertured portions said registration ridge extending forwardly from said main body member, at least a portion of said registration ridge being adapted to extend into said single hole of said outlet cover plate.

* * * * *